US005392466A

United States Patent [19]

Chou et al.

[11] Patent Number: 5,392,466

[45] Date of Patent: Feb. 28, 1995

[54] UPPER GARMENT FOR PATIENTS

[76] Inventors: Chia-Tien Chou, No. 168, Kuang Fu Road, Chang Hwa City, Chang Hwa; Chao-Mu Chou, 2F, No. 14, Alley 123, Lane 3, Jen Ai Road, Taipei, both of Taiwan, Prov. of China

[21] Appl. No.: 55,833

[22] Filed: Apr. 29, 1993

[30] Foreign Application Priority Data

May 20, 1992 [CN] China ..... 92222938

[51] Int. Cl.[6] ..... A41D 13/00; A41C 1/00

[52] U.S. Cl. ..... 2/114; 2/105; 2/106; 2/69; 2/912

[58] Field of Search ..... 2/75, 80, 104, 105, 2/106, 113, 114, 115, DIG. 7, 69, 69.5, 46, 912, 913, 914, 915

[56] References Cited

U.S. PATENT DOCUMENTS

| | | | |
|---|---|---|---|
| 818,351 | 4/1906 | Clark | 2/114 |
| 2,073,711 | 3/1937 | Robinsohn | 2/126 |
| 2,677,826 | 5/1954 | Piacenza | 2/115 |
| 3,721,998 | 3/1973 | Meyers | 2/DIG. 7 X |
| 4,004,294 | 1/1977 | Pinch | 2/104 |
| 4,258,440 | 3/1981 | McGowan | 2/DIG. 7 |
| 4,663,782 | 5/1987 | Knox et al. | 2/104 |
| 4,718,124 | 1/1988 | Sawicki et al. | 2/114 |
| 4,964,173 | 10/1990 | Gordon et al. | 2/114 |
| 5,097,535 | 3/1992 | Dye et al. | 2/104 |
| 5,150,477 | 9/1992 | Elberson et al. | 2/114 |
| 5,184,351 | 2/1993 | Benstock | 2/114 |

FOREIGN PATENT DOCUMENTS

| | | | |
|---|---|---|---|
| 38184 | 3/1909 | Austria | 2/115 |
| 16900 | of 1911 | United Kingdom | 2/115 |
| 355023 | 8/1931 | United Kingdom | 2/126 |

*Primary Examiner*—Jeanette E. Chapman
*Attorney, Agent, or Firm*—Bucknam and Archer

[57] ABSTRACT

An upper garment including a garment body formed by connecting a front half body panel with a back half body panel, and two sleeves respectively formed by connecting a respective front half sleeve panel with a respective back half sleeve panel, the front half body panel having at least one side detachably connected to a corresponding side of the back half body panel, the front half sleeve panel of at least one sleeve has one side detachably connected to a corresponding side of the respective back sleeve panel. An armpit hole, a shoulder hole, and a pocket with a through hole are respectively made on the garment body and shielded with a respective flap.

1 Claim, 1 Drawing Sheet

UPPER GARMENT FOR PATIENTS

BACKGROUND OF THE INVENTION

The present invention relates to upper garments and more particularly to an upper garment for patients which can be conveniently put on the sick and removed therefrom by the person who takes care of the sick.

Taking care of an apoplectic or paralytic patient is not an easy job. The person who takes care of the sick may have to expend a lot of time on dressing the sick. Therefore, there is a strong demand for garments specially designed for the persons who are incapable of dressing themselves.

The present invention has been accomplished under the aforesaid circumstances. It is therefore the principal object of the present invention to provide an upper garment which can be conveniently put on the sick and removed therefrom by the person who takes care of the sick.

The present invention will now be described by way of example with reference to the only drawing of FIG. 1 which is a perspective view of an upper garment according to the preferred embodiment of the present invention.

DETAILED DESCRIPTION OF THE PREFERRED EMBODIMENT

Figure 1:
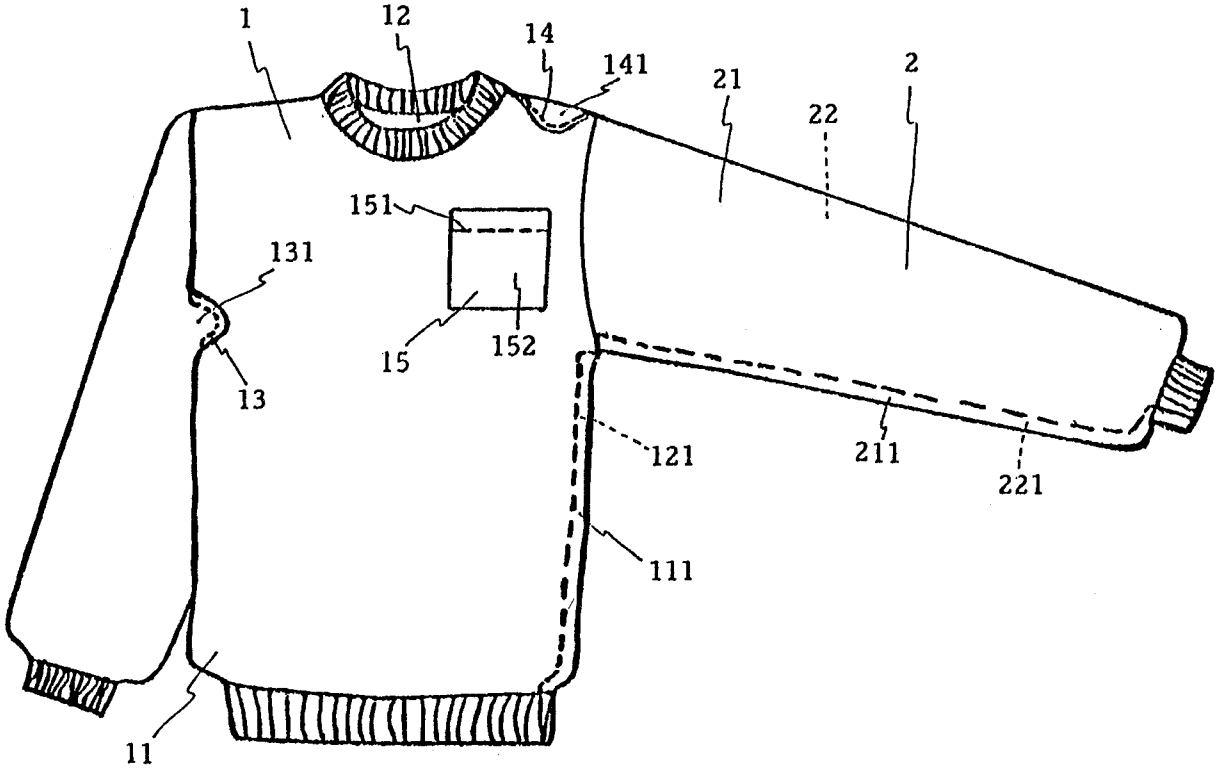

Referring to FIG. 1, an upper garment in accordance with the present invention is generally comprised of a garment body 1, and two sleeves 2. The garment body 1 is comprised of a front half body panel 11 and a back half body panel 12. The front half body panel 11 has two opposite lateral sides respectively connected to the two opposite lateral sides of the back half body panel 12. At least one lateral side of the front half body panel 11 is detachably connected to the corresponding lateral side of the back half body panel 12 by fastening elements 111;121. The sleeve 2 is comprised of a front half sleeve panel 21 and a back half sleeve panel 22. The front half sleeve panel 21 has two opposite lateral sides respectively connected to the two opposite lateral sides of the back half sleeve panel 22. At least one lateral side of the front half sleeve panel 21 is detachably connected to the corresponding lateral side of the back half sleeve panel 22 by fastening elements 211;221. FIG. 1 illustrates only one lateral side of the front and back half body detachably connected together and only one lateral side of the front and back half sleeve is detachably connected together.

In order to facilitate the procession of a physical therapy or a medical treatment, an armpit hole 13 is made on the garment body 1 at either armpit between the front half body panel 11 and the back half body panel 12 and shielded with a flap 131, and a shoulder hole 14 is made on the garment body 1 at either shoulder between the front half body panel 11 and the back half body panel 12 and shielded with a flap 141. There is a breast pocket 15 made on the front half body panel 11. The breast pocket 15 comprises a pocket panel 152 sewn on the front half body panel 11, and an opening 151 through which the tubing of a medical instrument can be inserted. The breast pocket 15 with the flap 152 covers the opening 151 through said garment body. FIG. 1 illustrates only one armpit hole/flap, only one shoulder hole/flap and only one opening/pocket panel.

For putting on a patient having one hand movable and the other hand paralyzed, the garment body 1 is pulled over the head of the patient, then the movable hand of the patient is inserted through the sleeve without having the fastening elements 211;221, and then the front half body panel 11 and back half body panel 12 of the garment body 1 are covered over the upper body of the patient and sealed by connecting the respective fastening elements 111;121 together, and then the front half sleeve panel 21 and back half sleeve panel 22 of the other sleeve 2is covered over the paralyzed hand of the patient and sealed by connecting the respective and fastening elements 211;221 together.

During an examination or a medical treatment, the garment body 1 may be opened by detaching the front half body panel 11 from the back half body panel 12 at one side, or the sleeve 2 may be opened by detaching the front half sleeve panel 21 from the back half sleeve panel 22 at one side. The shoulder hole 14 and the armpit hole 13 may be opened for the performance of a medical examination or a medical treatment.

While only one embodiment of the present invention has been shown and described, it will be understood that various modifications and changed could be made thereunto without departing from the spirit and scope of the invention. For example, zip fasteners, buttons, laces, magic tapes may be used for fastening the front and back half body panels of the garment body or the front and back sleeve panels of the sleeve; the two opposite sides of the front and back half body panels may be made detachable; the front and back half sleeve panels of each sleeve may be made detachable.

What is claimed is:

1. An upper body garment for an apoplectic or paralytic patient comprising a garment body and two sleeves, said garment body comprising a front half body panel and a back half body panel, wherein said front half body panel has only one lateral side detachably connected to a corresponding side of said back half body panel; at least one of said sleeves comprising a front half sleeve panel and a back half sleeve panel, the front half sleeve panel of said at least one sleeve having only one side detachably connected to a corresponding side of the respective back sleeve panel, and wherein said garment body has a hole at only one armpit shielded with a flap, and a shoulder hole on only one shoulder shielded with a flap, and only one breast pocket with flap to cover an opening through said garment body.

* * * * *